US006471608B1

(12) United States Patent
Mitchell

(10) Patent No.: US 6,471,608 B1
(45) Date of Patent: Oct. 29, 2002

(54) BREAKAGE-RESISTANT BASEBALL BAT AND PRODUCTION THEREOF

(76) Inventor: Joseph D. Mitchell, R.D. 1, Box 460, Brookville, PA (US) 15825

( * ) Notice: Subject to any disclaimer, the term of this patent is extended or adjusted under 35 U.S.C. 154(b) by 0 days.

(21) Appl. No.: 09/974,669

(22) Filed: Oct. 11, 2001

(51) Int. Cl.[7] ..... A63B 59/06
(52) U.S. Cl. ..... 473/564; 427/441
(58) Field of Search ..... 473/564–568, 473/457; 427/440–443

(56) References Cited

U.S. PATENT DOCUMENTS

| | | | | | |
|---|---|---|---|---|---|
| 1,770,403 | A | * | 7/1930 | Hanna | 473/564 |
| 1,936,579 | A | * | 11/1933 | Beck et al. | 473/564 |
| 2,039,221 | A | * | 4/1936 | Hillerich | 473/564 |
| 2,069,723 | A | * | 2/1937 | Morrow | 473/564 |
| 2,793,859 | A | * | 5/1957 | Darling et al. | 473/564 |
| 3,220,731 | A | * | 11/1965 | Germino et al. | 473/123 |
| 3,460,979 | A | | 8/1969 | Giese et al. | |
| 3,472,294 | A | * | 10/1969 | Franscioni | 473/564 |
| 3,535,795 | A | | 10/1970 | Olsen | |
| 3,579,369 | A | * | 5/1971 | Foster | 427/297 |
| 3,808,030 | A | * | 4/1974 | Bell | 427/289 |
| 4,116,252 | A | * | 9/1978 | Ikeda | 144/380 |
| 4,718,943 | A | | 1/1988 | Alscher et al. | |
| 5,970,624 | A | | 10/1999 | Moriya | |
| 6,050,910 | A | | 4/2000 | Holman et al. | |

* cited by examiner

*Primary Examiner*—Mark S. Graham
(74) *Attorney, Agent, or Firm*—Norman B. Rainea

(57) ABSTRACT

A baseball bat which meets Major League specifications is fabricated from porous red oak wood. The pores of the handle portion of the bat contain an impregnation oil. The resultant bat provides greater ball-hitting power while having greater resistance to breakage. The process for producing the bat involves slow and uniform drying of individual hardwood billets under conditions which provide non-warped dry billets having 4%–8% $H_2O$. The dry billet is then shaped to the bat configuration and impregnated with a penetrating oil while standing upright in a vacuum/pressure chamber.

13 Claims, 1 Drawing Sheet

BREAKAGE-RESISTANT BASEBALL BAT AND PRODUCTION THEREOF

BACKGROUND OF THE INVENTION

1. Field of the Invention

This invention concerns baseball bats having reduced tendency toward breakage, and more particularly relates to a baseball bat fabricated of hardwood and having enhanced resiliency.

2. Description of the Prior Art

Baseball bats, particularly those constructed of wood, are well known in the art. Baseball bats approved for use in the professional major leagues are turned from a solid piece of wood and include a handle portion terminating at a first or lower end in an integral knob. An outwardly tapered intermediate portion extends from the handle portion and merges upwardly with a ball hitting barrel portion, said barrel portion terminating at a second or upper end.

The most widely used wooden bats are fabricated of a hardwood such as ash derived from ash trees having the scientific classification: family: Oleaceae; genus: Fraximus. Ash wood is hard, strong and stiff, and possesses a relatively straight grain. Hardwoods in general have a cellular structure which includes vessels of a continuous elongated nature. When said vessels are cut transversely across the grain direction, the exposed open end is caused to have open pores. Because such pores extend the length of a piece of the wood in the direction of the grain, said hard woods are considered to be porous woods.

Such hardwood bats, however, are very prone to chipping, denting and outright breaking during game play. Lower grades of ash may not be as resilient as higher grades, resulting in a ball not travelling as far once it has been hit with a specified degree of force and speed.

The failure mode by which baseball bats break is not fully understood. However, it is clear that the point of impact with the ball, typically on the barrel of the bat, is not the likely location of the break. The most common location at which a baseball bat will break is in or near the handle portion, in a location where the bat is relatively small in diameter.

Upon impact with a ball, a baseball bat will vibrate. It is thought that, under typical strenuous conditions, the bat will momentarily assume a shape that is very slightly sinusoidal. Typically, there will be two nodes along the length of the bat, between which the bat will be deformed for a short period to a greater or lesser degree. Many factors may determine the amplitude and frequency of the vibration, including the structure of the bat, the grip strength and location by the player, the point of impact of the ball and the speed and direction of the ball and bat.

If the impact of the ball is sufficiently forceful, and various of the above factors combine unfavorably, the bat will break. Due to a combination of the forces involved and the strength characteristics of most bats, the location of the break is almost invariably at a location between the nodes, in the handle or in the area of transition between the handle and the barrel.

Even if the traditional ash bat survives catastrophic failure upon contacting a pitched ball, the hitting surface of the barrel will quickly erode due to the repeated contact with the ball. Baseball players, particularly professionals, have adopted the practice of taping the barrel of ash bats in batting practice to prolong their usefulness by reducing the aforementioned surface deterioration, this being an undesirable necessity in prolonging the life of ash bats. As a result of this problem, the typical professional hitter will go through an average of 73 ash bats during a typical major league baseball season of 162 games.

The red oak tree, family: Fagaceae; genus: Quercus; species: rubra, provides a porous hardwood. It is more abundant than ash, and has physical properties more desirable than ash for use in baseball bats. In particular, red oak is harder and more resilient than ash. However, prior efforts to fabricate approved baseball bats of red oak have been unsuccessful because of difficulties in drying thick billets without warping and/or cracking.

It is well known that wood can be impregnated with various agents in fluid form to achieve property modifications. However, such impregnation treatments have not been successfully applied to baseball bats. It is further known that various coatings and wrappings have been applied to the handle portion of baseball bats in an effort to minimize breakage or mitigate the effects thereof. Such expedients have either been unsuccessful, disapproved for Major League use, or have adversely affected desirable characteristics of the bat.

It is accordingly an object of the present invention to provide a wooden baseball bat having improved durability.

It is a further object of this invention to provide a baseball bat as in the foregoing object which meets the requirements of acceptability by Major League authorities.

It is another object of the present invention to provide a baseball bat of the aforesaid nature constructed of a hardwood and having improved resiliency.

It is a still further object of this invention to provide a baseball bat of the aforesaid nature constructed of red oak wood.

It is yet another object of the present invention to provide a process for the production of the aforesaid red oak baseball bat.

These objects and other objects and advantages of the invention will be apparent from the following description.

SUMMARY OF THE INVENTION

The above and other beneficial objects and advantages are accomplished in accordance with the present invention by a baseball bat of monolithic construction fabricated of red oak wood and comprised of a handle portion terminating at a first or lower end in an integral knob, an outwardly tapered intermediate portion extending from said handle portion, and a ball hitting barrel portion merging with said intermediate portion and terminating in a second or upper end, said bat containing an impregnated oil extending from said lower end through at least said handle portion, and an oil-impervious coating covering the entire bat.

The aforesaid improved baseball bat is made by a process wherein a billet of red oak wood is slowly and evenly dried in a vacuum kiln to a moisture content in the range of 4%–8% $H_2O$, then turned into shape and sanded, and placed upright in a chamber which achieves vacuum impregnation with an oil composition to a height of between about 18 and 22 inches of said bat. The oil-impregnated bat is then removed from the chamber, and is coated overall with a film-forming agent compatible with and impervious to said oil.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
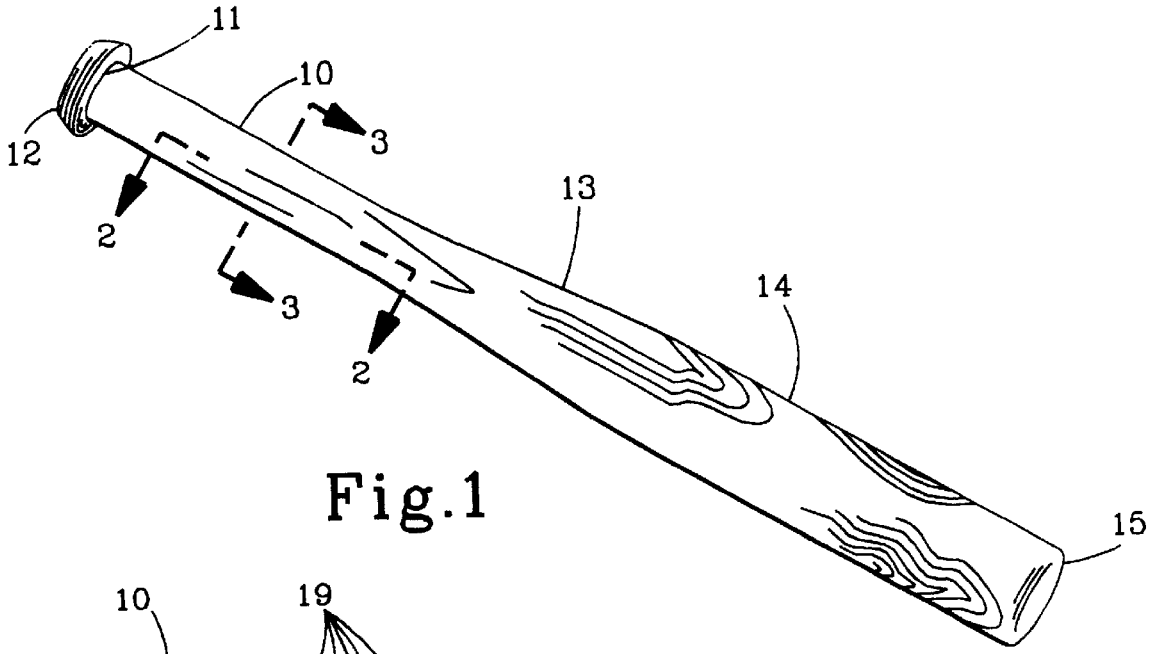
FIG. 1 is a perspective view of an embodiment of the baseball bat of the present invention.
Figure 2:
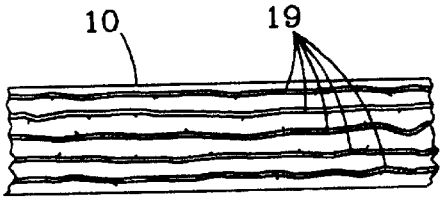
FIG. 2 is an enlarged schematic sectional view taken in the direction of the arrows upon line 2—2 of FIG. 1.
Figure 3:
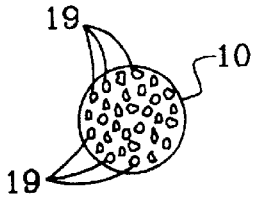
FIG. 3 is an enlarged schematic sectional view taken on the line 3—3 of FIG. 1.
Figure 4:
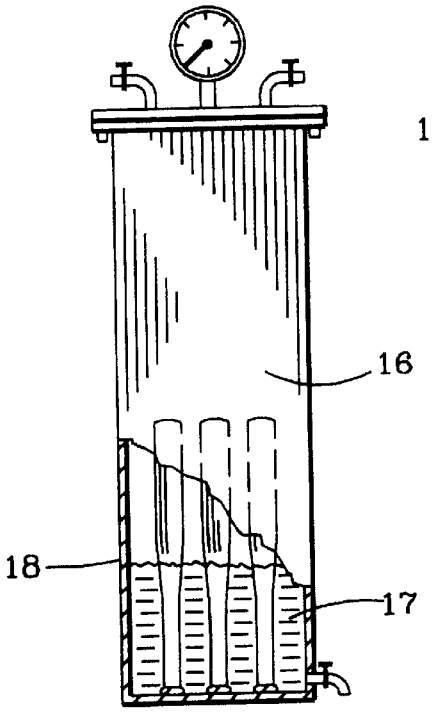
FIG. 4 is a sectional side schematic view with portions broken away illustrating an embodiment of the bat-treating process of this invention.

Referring now to FIG. 1, an embodiment of the baseball bat of the present invention of monolithic wooden construction is shown comprised of a handle portion 10 terminating at a first or lower end 11 having an integral knob 12. An outwardly tapered intermediate portion 13 extends from said handle portion and merges with a ball-hitting barrel portion 14 terminating in a second or upper end 15. The overall length of the bat, measured between said first and second ends, is between 28 and 36 inches.

The bat of this invention is produced by first drying red oak hardwood billets of about 3¼"×3¼"×37" size in a vacuum kiln, at relatively low temperatures of 90° F. to 170° F. for 8 to 10 days. The kiln is provided with heated plates interleaved with said billets, and further contains condenser means for removing evaporated water. The vacuum in the kiln is maintained at 27 to 29 inches of mercury. The dried billets will have a moisture content in the range of 4%–8% $H_2O$. The dried billets are then shaped, as on a lathe, and sanded to produce the bat structure. The bats are then placed in a pressure chamber 16 in upright position standing upon the knob lower extremity. A penetrating oil composition 17 is added to the lower part 18 of the chamber, and the head space of the chamber is evacuated to a vacuum of between 20 and 29 inches of mercury. Such condition is maintained at 130° F. to 140° F. for about 30 minutes. The pressure in the headspace is then increased to 110 psi, causing the oil to enter the lowermost 18–22 inches of the pores of the bat in the course of a residence time of about 2½ hours.

The penetrating oil composition is preferably a homogenous oleophilic liquid of low volatility having a viscosity between about 40 and 5 centipoise at temperatures ranging from 120° F. to 150° F., respectively. Oils having too high a viscosity do not readily enter the pores of the wood. Oils having too low a viscosity are not retained within the pores. Particularly preferred oils are "drying" oils such as linseed oil which thicken or solidify upon exposure to air. Because of such drying characteristic, the exterior of the bat will not retain an oily coating. Oils of sufficiently low volatility will have a boiling point higher than 375° F. at atmospheric pressure.

The oil impregnated bats are removed from the chamber. Excess oil is removed by wiping and applying a blowing pressure from the upper end of the bat. The amount of oil retained within the pores of the bat will range from 1 to 2 ounces. The bat is then dipped into a coating agent which is compatible with, and preferably miscible with the penetrating oil. A preferred coating agent is tung oil. When the tung oil coating is dry, the bat is dipped into a water-based lacquer.

It has been found that red oak baseball bats produced in the aforesaid manner have improved elasticity, and consequently deliver a better hit than the non-impregnated bat.

A further understanding of my invention will be had from a consideration of the following example which illustrates certain preferred embodiments. It is understood that the instant invention is not to be construed as being limited by said example or by the details therein.

EXAMPLE 1

Red oak billets measuring 3¼"×3¼"×37" were dried in a kiln at a temperature of 130° F. for 9 days. The resultant billets have a moisture content of 5%. The dried billets were then shaped by a lathe and sanded to produce baseball bats of 34" length, having handle portions of 1" diameter, and meeting Major League dimensional specifications.

The bats were then placed in a pressure vessel in vertical position, standing upon their knob extremities. A penetrating oil comprised of boiled linseed oil and at a temperature of 135° F. was added to the lower portion of the chamber. The headspace in the chamber was evacuated to a vacuum of 24 inches of mercury, which was maintained for 30 minutes. The pressure in the vessel was then increased to 110 psi, and maintained for 2.5 hours, causing the oil to rise 20 inches into the bat. The bats were then removed. Excess oil was removed by wiping and by applying a high pneumatic pressure to the upper end of the bat. The amount of residual oil remaining within the pores of the bats averaged 1¼ ounce.

The bats were then coated with tung oil and dried. Each bat was next dipped into a water-based lacquer, and re-dried.

Bats produced in the aforesaid manner were tested on a Baum Hitting Machine at the University of Massachusetts Lowell Baseball Research Center using Rawlings Major League Baseballs. The swing speed was 66 +/−1 mph as measured at a point 6 inches below said second or upper end. The test results indicated that bats produced by way of this example produced a struck ball speed of 94.14 miles per hour versus a struck ball speed of only 93.78 miles per hour for ash bats of comparable construction.

In still other tests, it was found that bats produced in this example could be flexed to a 5" deformation from the center axis of the bat before breaking, whereas the same bats but without oil impregnation could at best be flexed only 3" before breaking. When the bats were sectioned for examination, it was found that the oil filled the longitudinal vessels 19 in handle portion 10.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A baseball bat fabricated of a monolithic piece of porous red oak wood and comprised of a handle portion terminating at a first or lower end in an integral knob, an outwardly tapered intermediate portion extending from said handle portion, and a ball hitting barrel portion merging with said intermediate portion and terminating in a second or upper end, said bat containing an impregnated oil extending from said lower end through said handle portion, and an oil-impervious coating covering the entire bat.

2. The baseball bat of claim 1 containing between 1 and 2 ounces of said oil.

3. The baseball bat of claim 2 wherein said oil-impervious coating is compatible with said oil.

4. The baseball bat of claim 3 wherein said oil extends within the pores of said bat a distance between 18 and 22 inches, measured from said first end.

5. The baseball bat of claim 1 having a length between 28 and 36 inches and capable of undergoing flexural deformation up to 5 inches without breaking.

6. The baseball bat of claim 1 further characterized in being able to produce a struck ball speed greater than 94 miles per hour when tested on a Baum Hitting Machine using a Rawlings Major League Baseball.

7. A process for making a baseball bat of a porous hardwood conforming to Major League specifications comprising:

a) drying a billet of a porous hardwood sufficiently slowly and evenly so as to produce a non-warped dry billet having a moisture content in the range of 4%–8% $H_2O$, b) shaping the billet to the form of the desired baseball bat, having a handle portion terminating at a first extremity in an integral knob, an outwardly tapered intermediate portion extending from said handle portion, and a ball hitting barrel portion merging with said intermediate portion and terminating in an upper end, c) placing said bat upright in a chamber which achieves impregnation of said bat to a height of between about 18 and 22 inches with a penetrating oil, d) removing said bat from said chamber and removing excess penetrating oil, and e) applying to said bat a coating of a film-forming agent compatible with said oil.

8. The process of claim 7, wherein said bat is caused to contain between 1 and 2 ounces of said penetrating oil.

9. The process of claim 8 wherein said bat has a length between 28 and 36 inches.

10. The process of claim 7 wherein said oil is a drying oil.

11. The process of claim 7 wherein said oil has a viscosity between about 40 and 5 centipoise at temperatures ranging from 120° F. to 150° F., respectively.

12. The process of claim 7 wherein said hardwood is red oak.

13. The process of claim 7 wherein said hardwood is ash.

* * * * *